US011434932B2

(12) United States Patent
Baltes et al.

(10) Patent No.: US 11,434,932 B2
(45) Date of Patent: Sep. 6, 2022

(54) BELLOWS ACCUMULATOR

(71) Applicant: HYDAC TECHNOLOGY GMBH, Sulzbach/Saar (DE)

(72) Inventors: Herbert Baltes, Losheim (DE); Peter Kloft, Ransbach-Baumbach (DE)

(73) Assignee: HYDAC TECHNOLOGY GMBH, Sulzbach/Saar (DE)

( * ) Notice: Subject to any disclaimer, the term of this patent is extended or adjusted under 35 U.S.C. 154(b) by 0 days.

(21) Appl. No.: 17/275,745

(22) PCT Filed: Sep. 9, 2019

(86) PCT No.: PCT/EP2019/073918
§ 371 (c)(1),
(2) Date: Mar. 12, 2021

(87) PCT Pub. No.: WO2020/053113
PCT Pub. Date: Mar. 19, 2020

(65) Prior Publication Data

US 2022/0034334 A1 Feb. 3, 2022

(30) Foreign Application Priority Data

Sep. 14, 2018 (DE) ..... 10 2018 007 279.8

(51) Int. Cl.
*F15B 1/10* (2006.01)

(52) U.S. Cl.
CPC ..... *F15B 1/103* (2013.01); *F15B 2201/205* (2013.01); *F15B 2201/3153* (2013.01);
(Continued)

(58) Field of Classification Search
CPC ..... F15B 1/103; F15B 1/24; F15B 2201/31; F15B 2201/312; F15B 2201/3153;
(Continued)

(56) References Cited

U.S. PATENT DOCUMENTS 1,366,473 A * 1/1921 Mallory ..... F16J 3/04
236/93 R
3,158,180 A * 11/1964 Greer ..... F15B 1/24
138/31

(Continued)

FOREIGN PATENT DOCUMENTS

DE 10 2006 004 120 7/2007
DE 101 16 995 9/2008

(Continued)

OTHER PUBLICATIONS

International Search Report (ISR) dated Nov. 14, 2019 in International (PCT) Application No. PCT/EP2019/073918.

*Primary Examiner* — Robert K Arundale
*Assistant Examiner* — Richard K. Durden
(74) *Attorney, Agent, or Firm* — Wenderoth, Lind & Ponack, L.L.P.

(57) ABSTRACT

A bellows accumulator has at least one accumulator housing (2) and a separating bellows (20) movably arranged in the accumulator housing (2). The separating bellows 20 has a plurality of bellows folds and separates two media spaces (8, 22) from one another. The stationary open end of the separating bellows (20) is fixed to the accumulator housing (2) by a securing device (24). The separating bellows (20) has, at its movable other end, a closure part (36) having a guide device (40) by which the closure part (36) is guided in the accumulator housing (2). The closure part (36) has, in addition to the guide device (40), a sealing device (50). At least in the one extended end position of the separating bellows (20), the sealing device (50) separates a fluid space (8), in which the bellows folds are arranged in the accumulator housing (2), from a fluid port (12) in the accumulator housing (2). At least in some of the other working positions, the sealing device (50) releases this fluid connection.

13 Claims, 2 Drawing Sheets

(52) U.S. Cl.
CPC ..... *F15B 2201/3156* (2013.01); *F15B 2201/3157* (2013.01); *F15B 2201/3158* (2013.01); *F15B 2201/4056* (2013.01)

(58) Field of Classification Search
CPC ..... F15B 2201/3157; F15B 2201/3158; F15B 2201/32; F15B 2201/435; F16J 3/043; F16J 3/047; F16J 3/048; F16J 3/06; F16L 55/053
See application file for complete search history.

(56) References Cited

U.S. PATENT DOCUMENTS 3,613,734 A * 10/1971 Elmer ..... F15B 1/24 138/31
4,691,739 A * 9/1987 Gooden ..... H05K 7/20272 73/40.5 R
4,714,094 A * 12/1987 Tovagliaro ..... F15B 1/24 220/62.19
6,286,552 B1 9/2001 Shimbori et al.
6,622,755 B2 * 9/2003 Weber ..... F15B 1/22 138/30
2001/0037834 A1 11/2001 Shimbori et al.
2008/0314467 A1 * 12/2008 Gray, Jr. ..... F15B 1/24 138/30
2012/0211110 A1 * 8/2012 Baltes ..... F15B 1/103 138/30
2012/0211111 A1 * 8/2012 Baltes ..... F15B 1/103 138/30
2014/0311604 A1 * 10/2014 Yoshihara ..... F15B 1/103 138/30
2015/0204357 A1 * 7/2015 Hyodo ..... F15B 1/103 138/30
2016/0108935 A1 * 4/2016 Arikawa ..... F15B 1/103 92/47
2018/0245656 A1 * 8/2018 Baltes ..... F16F 9/082

FOREIGN PATENT DOCUMENTS

DE 10 2015 012 253 3/2017
EP 1 052 412 11/2000
EP 1918626 A1 * 5/2008 ..... F02M 37/0041
EP 2 519 748 10/2016
JP 2-46301 2/1990
JP 2000-249101 9/2000
JP 2002-242902 8/2002

* cited by examiner

BELLOWS ACCUMULATOR

FIELD OF THE INVENTION

The invention relates to a bellows accumulator having of at least one accumulator housing and having a separating bellows, which is movably arranged in the accumulator housing. The separating bellows has a plurality of bellows folds and separates two media spaces from each other in the accumulator housing. The stationary open end of the separating bellows is fixed to the accumulator housing by a securing device. The separating bellows has, at its movable other end, a closure part having a guide device used to guide the closure part in the accumulator housing.

BACKGROUND OF THE INVENTION

Bellows accumulators of this type are state of the art, see for instance DE 10 2015 012 253 A1 (corresponding to U.S. Patent Application Publication No. 2018/0245656). Bellows accumulators are advantageously used in hydraulic systems, preferably to reduce or smooth pressure peaks occurring in pressure fluids. To ensure that the separating bellows during operation can move freely and without the risk of damage into its respective working positions, the outer diameter of a bellows is selected to be slightly smaller than the inner diameter of the accumulator housing. The guide device of the closure part is used to guide the bellows such that a gap is formed between the tips of the bellows and the housing wall in the working positions. This gap forms a part of the media chamber of the liquid side and, in operation, is pressurized with the fluid pressure applied from one fluid port. The inside of the bellows, from its open end, is pressurized with the pre-fill pressure existing in the other media chamber. During operation, the pressure balance between the liquid pressure acting in the gap and the pre-fill pressure prevents the bellows from being pressed against the inner wall of the housing and being damaged. However, this prevention is different in operating states, in which the liquid side is depressurized or the liquid pressure drops below the pre-fill pressure. Because of the pressure present in the bellows' interior, when the gap is depressurized or only slightly pressurized, the tips of the bellows are pressed against the inner wall of the housing and damaged thereby.

SUMMARY OF THE INVENTION

With regard to this problem, the invention addresses the problem of providing a bellows accumulator of the genus mentioned above, which is characterized by a high degree of operational reliability compared to the prior art.

According to the invention, this problem is basically solved by a bellows accumulator having, as an essential feature of the invention, the closure part having, in addition to the guide device or guide, a sealing device or seal. At least in the one extended end position of the separating bellows, the sealing device separates a fluid space, in which the bellows folds are arranged in the accumulator housing, from a fluid port in the accumulator housing and releases this fluid connection, at least in some of the other working positions. In this way, in operation when the fluid connection is released, the mode of operation of the bellows accumulator according to the invention equals that of the known bellows accumulator mentioned, as long as the bellows is not in the extended end position and the pressure between the fluid chamber in the gap and the bellows interior is balanced.

As soon as the bellows reaches its extended end position because of a predominant pre-fill pressure, the sealing device of the guide unit blocks the fluid chamber on the outside of the bellows. The enclosed fluid volume supports the bellows against the pre-fill pressure acting from the interior. The bellows is thereby protected against damage at pressure ratios, where the pre-fill pressure is greater than the liquid pressure. If temperature changes occur in the operating state, in which the liquid volume in the gap is enclosed by the sealing device, with a resulting expansion or contraction of the fluid volume corresponding to the coefficient of thermal expansion, this may cause a deformation of the bellows. To keep this deformation and accordingly the stresses in the bellows below a threshold value, which could negatively affect the service life of the bellows, the gap width and accordingly the enclosed liquid volume are set to a small size. As stated in the prior art document DE 10 2015 012 253 A1 cited, the gap dimension in bellows accumulators of this type can be smaller than 1 mm. In such small liquid volumes, temperature changes are not critical even across a wide range. The bellows accumulator according to the invention can therefore also be used advantageously in aerospace applications where high temperature differences must be safely controlled.

Advantageously, the sealing device on the closure part can be set back reduced in the diameter from the guide device. At the housing side, a housing wall part reducing the inner diameter of the housing and forming a sealing surface can be provided for interaction with the sealing device having a reduced diameter.

In advantageous exemplary embodiments, the closure part has a dome at its end facing the fluid port. In the area of the fluid port the convex outer contour of the dome follows the inner contour of the accumulator housing and is brought at least partially into contact with that inner contour in one end position. In the end position, practically no fluid dead volume remains in the area of the accumulator housing adjacent to the fluid port.

Advantageously, a shoulder is formed on the inside of the accumulator housing. Against said shoulder, the separating bellows moves in its one end position, closing the port.

Advantageously, the arrangement can be made in such a way that the shoulder is provided with a slope that tapers in the direction of the port and that forms a blocked fluid transition between the guide device and the sealing device in the one end position that closes the port. The conical surface can form a ramp, up which the sealing device moves onto a projecting sealing surface of the accumulator housing when the end position is reached.

In advantageous exemplary embodiments, the guide device of the closure part has a guide ring having individual guide segments, which are in contact with the inner wall of the accumulator housing in every working position of the separation bellows and delimit passage spaces for fluid therebetween. When the bellows is in the working positions, the fluid chamber on the outside of the bellows is connected to the fluid port via the passage spaces of the guide ring.

The outer diameter of the bellows folds can advantageously be selected to be slightly smaller than the assignable inner diameter of the accumulator housing such that in the fluid space partial spaces are formed. Those partial spaces in their entirety form a hydraulic damping of the fluid.

The sealing device can advantageously be arranged on the closure part between the guide device and the dome.

Advantageously, the arrangement is further such that in the end position of the separating bellows opposite from the one end position, the bellows folds are in full contact with one another.

In the manner known per se for bellows accumulators, the accumulator housing can be wrapped to increase its resistance to pressure. Such a wrap, technically known as a liner, can be formed from a glass fiber composite.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure.

DETAILED DESCRIPTION OF THE INVENTION

Figure 1:
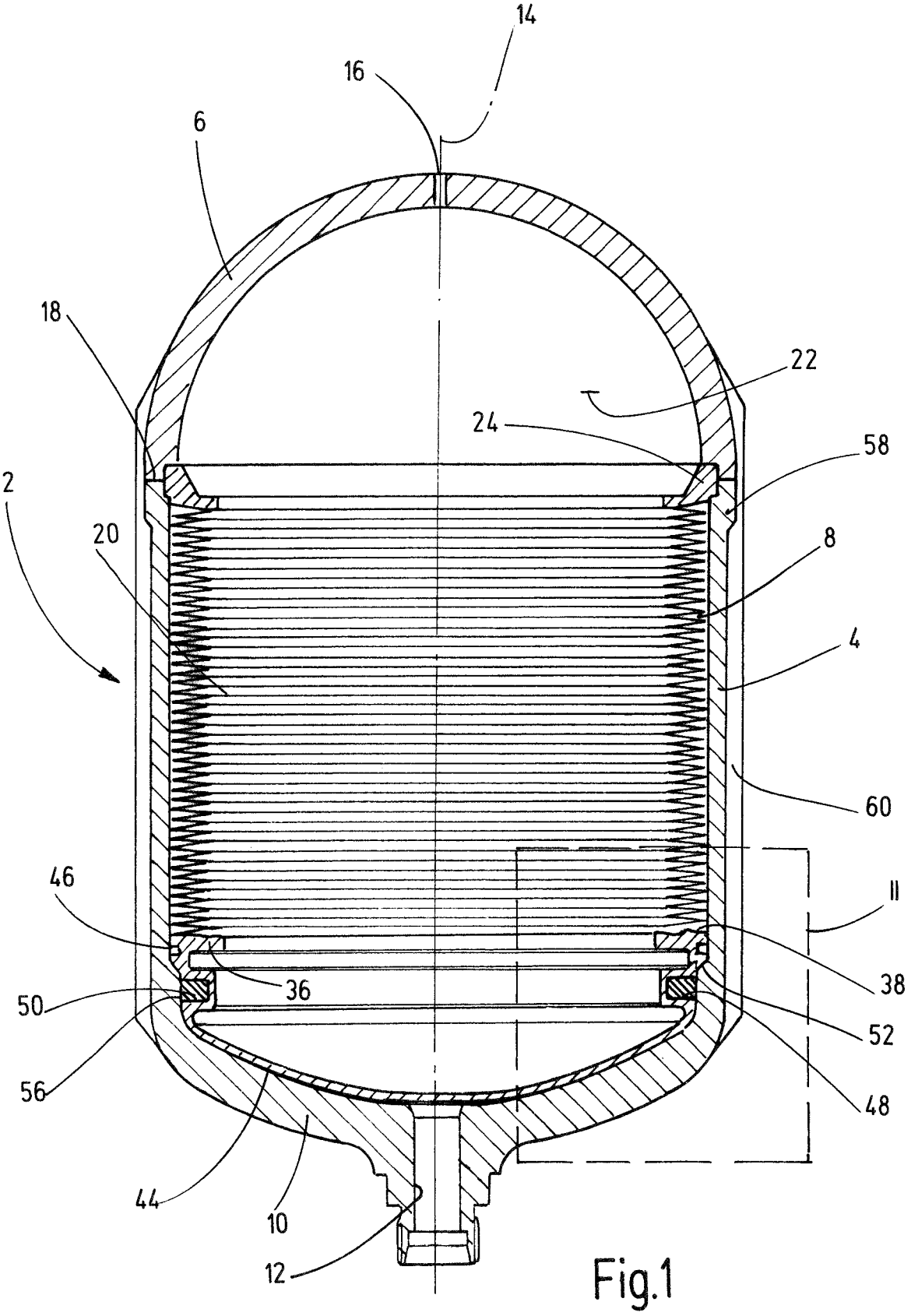
FIG. 1 is a side view in section of a bellows accumulator according to an exemplary embodiment of the invention.

The exemplary embodiment of the bellows accumulator according to the invention shown in FIG. 1 has an accumulator housing 2. Accumulator housing 2 has two housing parts, with one part forming a main housing part 4 and the other part forming a housing closing part 6. The main part 4 has the form of a pot having a circular-cylindrical interior 8 and a dome-shaped pot bottom 10, which is closed except for a fluid port 12 coaxial with the longitudinal axis 14. The closing part 6 is shaped like a semispherical bowl, which is closed except for a filling opening 16 coaxial with the axis 14. The main part 4 and the closing part 6 are welded together along their end rims facing each other at a weld line 18. A separating bellows in the form of a metallic bellows 20 is accommodated in the circular cylindrical interior 8 between the weld line 18 and the pot bottom 10. As is common with bellows for bellows accumulators, the bellows 20 is made of a stainless steel. In the present example, a chromium-nickel-molybdenum steel alloy (AM350) is provided. At its end at the top in FIG. 1, the bellows 20 is open to the gas end 22, adjacent to the filling opening 16 of the accumulator housing 2. The last bellows side of the bellows 20 at its top end is welded to a retaining ring 24, which forms the securing device used to fix the immovable bellows end of the bellows 20 to the accumulator housing 2. The retaining ring 24 is formed of stainless steel, for instance steel 1.4435, and is welded to the housing parts 4 and 6 at the weld line 18 by laser welding.

At its other, movable free end, which is opposite from the open bellows end connected to the retaining ring 24, the interior of the bellows 20, which is open towards the gas end 22, is closed by a closure part 36 made of stainless steel (such as steel 1.4435), which closure part is firmly welded to the facing bellows end. The closure part 36 has the shape of a circular bowl, on the outer circumference of which, starting from the open rim of the bowl 38, a guide device or guide 40 and a sealing device or seal 42 adjoining it are formed, see FIG. 2. As can be seen most clearly from FIG. 2, the guide device 40 has a circumferential annular groove 46 near the rim of the bowl 38. In that annular groove 46, a guide ring in the form of a flat ring 54 is received. The sealing device 42 has an annular groove 48 that is offset axially from the annular groove 46 of the guide device 40 in the direction towards the pot bottom 10 and that extends radially inwards. A gasket 50 is received in the annular groove 48. At the underside adjoining the lower annular groove 48, the closure part 36 is closed by a dome part 44.

Figure 2:
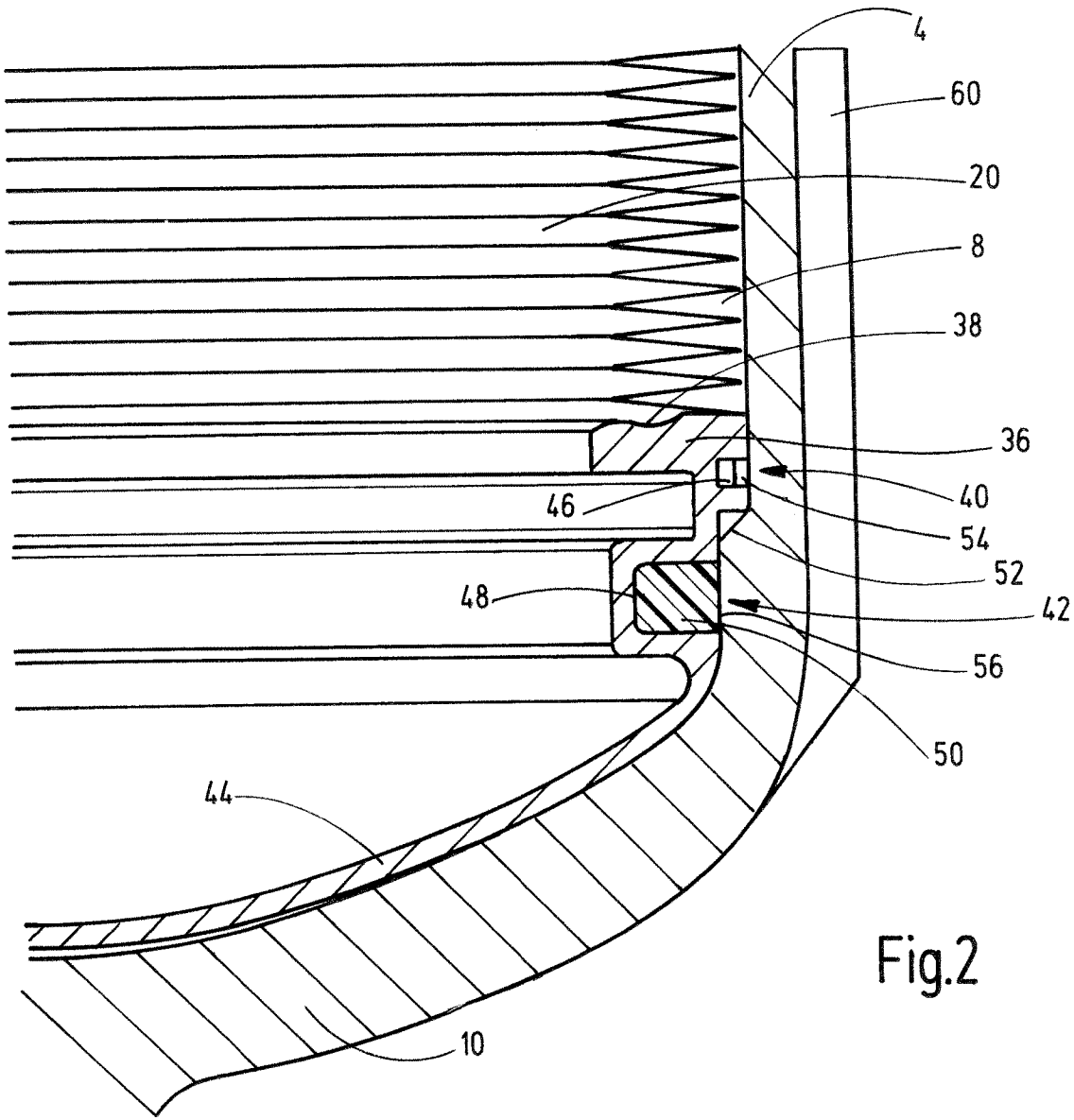
FIG. 2 is an enlarged partial side view in section of the area designated II in FIG. 1.

The flat ring 54, forming the guide ring of the guide device 40 in the annular groove 46, has the function of guiding the bellows folds along the inner wall during movements out of the end position shown in FIGS. 1 and 2, while maintaining a gap in the interior 8 between the tips of the bellows and the housing wall. For this purpose, the guide ring is made of a plastic having good sliding properties, such as polytetrafluoroethylene, as shown in FIGS. 5 and 6 of EP 2 519 748 B1. To form passage spaces at the circumference of the flat ring 54 to permit fluid to pass from the fluid port 12 into the interior 8 surrounding the bellows 20, recessed areas are formed as passage spaces at the circumference of the flat ring 54 between guide bodies abutting the housing wall as guide shoes. In operation, therefore, the interior 8, surrounding the bellows 20, forms a part of the fluid side. When the bellows 20 is not fully compressed, the spaces between the bellows folds form damping spaces as part of the fluid side. The volumes of the damping spaces change correspondingly during the bellows movements in operation. One damping throttle each is formed between every tip of the folds and the inner wall of the housing. The selected gap dimension between the inner wall of the main part 4 and the tips of the bellows determines the throttle cross-section.

As is most clearly shown in FIG. 2, a shoulder is formed at the transition between the main housing part 4 and the pot bottom 10. Up against the shoulder, the closure part 36 of the bellows 20 runs when in the extended end position. The shoulder is provided with a slope, which tapers in the direction of the fluid port 12, thereby forming a ramp surface 52. The gasket 50 of the sealing device 42 traverses ramp surface 52 during movement into the end position, and where the gasket comes into contact with a sealing surface 56 formed by a radially inwardly offset, circular cylindrical wall part of the accumulator housing. As a result, in the end position shown in the figures, the fluid connection between the fluid port 12 and the interior 8 is blocked, such that the volume of fluid, located in the gap of the interior 8, is enclosed as long as the bellows is in its extended end position. In the working positions, in which the gasket 50 has left the sealing surface 56, the fluid connection between the fluid port 12 and the gap in the interior 8 is opened for normal operation.

As shown in FIG. 1, the main housing part 4 has, starting from a thickened wall part 58 adjoining to the weld line 18, an area of reduced wall thickness extending to the area of the pot bottom 10. As indicated in FIG. 1, this area has a fiber wrap 60 of fiberglass material extending beyond the weld line 18 up to the beginning area of the housing part 6. The fiber wrap 60, increasing the compressive strength, with regard to their structure corresponds to the wraps known by the technical name "liner" in pressure vessels.

While one embodiment has been chosen to illustrate the invention, it will be understood by those skilled in the art that various changes and modifications can be made therein without departing from the scope of the invention as defined in the claims.

The invention claimed is:

1. A bellows accumulator, comprising:

an accumulator housing having a gas space and a fluid space with a fluid port and a concave inner contour adjacent the fluid port;

a separating bellows being movably arranged in the accumulator housing, having a plurality of bellows folds and separating the gas and fluid spaces from one another, a stationary open end of the separating bellows being fixed to the accumulator housing by a securer, a movable end of the separating bellows being opposite the stationary open end;

a closure part being coupled to the movable end of the separating bellows, having a guide guiding movement of the closure part in the accumulator housing and having a seal separating fluid communication of a portion of the fluid space with the bellows folds from the fluid port in an extended end position of the separating bellows and opening fluid communication in at least some other positions of the separating bellows in the accumulator housing; and a dome on an end of the closure part facing the fluid port, the dome having a convex outer contour facing the fluid port, conforming to the concave inner contour and at least partially contacting the concave inner contour in the extended end position of the separating bellows.

2. A bellows accumulator according to claim 1 wherein the seal on the closure part is set back from and has a reduced outer diameter relative to the guide.

3. A bellows accumulator according to claim 1 wherein a shoulder extends radially inwardly from the accumulator housing into the fluid space, the guide engaging the shoulder in the extended end position of the separating bellows.

4. A bellows accumulator according to claim 3 wherein the shoulder has a slope tapering in a direction away from the fluid port between the guide and the seal in the extended end position.

5. A bellows accumulator according to claim 1 wherein the guide of the closure part comprises a guide ring contacting an inner wall of the accumulator housing in every working position of the separating bellows.

6. A bellows accumulator according to claim 1 wherein the bellows folds have an outer diameter smaller than an adjacent inner diameter of the accumulator housing, forming partial spaces of the fluid space causing a hydraulic damping of hydraulic fluid in the fluid space when the separating bellows is moving.

7. A bellows accumulator according to claim 1 wherein the seal is arranged between the guide and the dome on the closure part.

8. A bellows accumulator according to claim 1 wherein the bellows folds are capable of being in contact with another in a position opposite the extended end position.

9. A bellows accumulator according to claim 1 wherein the accumulator housing has a wrapping increasing resistance to pressure.

10. A bellows accumulator, comprising:

an accumulator housing having a gas space and a fluid space with a fluid port and a concave inner contour adjacent the fluid port;

a separating bellows being movably arranged in the accumulator housing, having a plurality of bellows folds and separating the gas and fluid spaces from one another, a stationary open end of the separating bellows being fixed to the accumulator housing by a securer, a movable end of the separating bellows being opposite the stationary open end;

a closure part being coupled to the movable end of the separating bellows, having a guide guiding movement of the closure part in the accumulator housing and having a seal separating fluid communication of a portion of the fluid space with the bellows folds from the fluid port in an extended end position of the separating bellows and opening fluid communication in at least some other positions of the separating bellows in the accumulator housing; and a shoulder extending radially inwardly from the accumulator housing into the fluid space, the guide engaging the shoulder in the extended end position of the separating bellows, the shoulder having a slope tapering in a direction away from the fluid port between the guide and the seal in the extended end position.

11. A bellows accumulator, comprising:

an accumulator housing having a gas space and a fluid space with a fluid port and a concave inner contour adjacent the fluid port;

a separating bellows being movably arranged in the accumulator housing, having a plurality of bellows folds and separating the gas and fluid spaces from one another, a stationary open end of the separating bellows being fixed to the accumulator housing by a securer, a movable end of the separating bellows being opposite the stationary open end; and a closure part being coupled to the movable end of the separating bellows, having a guide guiding movement of the closure part in the accumulator housing and having a seal separating fluid communication of a portion of the fluid space with the bellows folds from the fluid port in at least one extended position of the separating bellows when the seal engages a shoulder extending radially inwardly from and fixed on the accumulator housing and opening the fluid communication in at least some other positions of the separating bellows in the accumulator housing when the seal is disengaged with the shoulder, the seal being arranged between the guide and a dome on the closure part.

12. A bellows accumulator according to claim 11 wherein the guide engages the shoulder in an extended end position of the separating bellows, the shoulder having a slope tapering in a direction away from the fluid port.

13. A bellows accumulator, comprising:

an accumulator housing having a gas space and a fluid space with a fluid port and a concave inner contour adjacent the fluid port;

a separating bellows being movably arranged in the accumulator housing, having a plurality of bellows folds and separating the gas and fluid spaces from one another, a stationary open end of the separating bellows being fixed to the accumulator housing by a securer, a movable end of the separating bellows being opposite the stationary open end;

a closure part being coupled to the movable end of the separating bellows, having a guide guiding movement of the closure part in the accumulator housing and having a seal separating fluid communication of a portion of the fluid space with the bellows folds from the fluid port in at least one extended position of the separating bellows and opening fluid communication in at least some other positions of the separating bellows in the accumulator housing; and a shoulder extending radially inwardly from and fixed on an inner surface of the accumulator housing into the fluid space having an end surface facing away from the fluid port and having an inwardly facing side surface, the end surface being engaged by the guide in an extended end position of the separating bellows, the seal engaging the side surface in the extended end position of the separating bellows.

* * * * *